US011419360B2

(12) United States Patent
Klipfel et al.

(10) Patent No.: US 11,419,360 B2
(45) Date of Patent: Aug. 23, 2022

(54) METHOD OF PRODUCING HIGH TENSILE STRENGTH HOMOGENIZED TOBACCO MATERIAL

(71) Applicant: Philip Morris Products S.A., Neuchatel (CH)

(72) Inventors: Yorick Klipfel, St-Saphorin-sur-Morges (CH); Marine Jarriault, Bern (CH); Rui Nuno Batista, Morges (CH); Pascal Rausis, Colombier (CH); Audrey Cally, Soral (CH); Corinne Deforel, Formangueires (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/755,176

(22) PCT Filed: Jun. 29, 2016

(86) PCT No.: PCT/EP2016/065223
§ 371 (c)(1),
(2) Date: Feb. 26, 2018

(87) PCT Pub. No.: WO2017/041920
PCT Pub. Date: Mar. 16, 2017

(65) Prior Publication Data

US 2018/0242631 A1 Aug. 30, 2018

(30) Foreign Application Priority Data

Sep. 8, 2015 (EP) ..... 15184288

(51) Int. Cl.
*A24B 15/14* (2006.01)
*A24C 5/01* (2020.01)
*A24B 3/14* (2006.01)

(52) U.S. Cl.
CPC ..... *A24B 15/14* (2013.01); *A24B 3/14* (2013.01); *A24C 5/01* (2020.01)

(58) Field of Classification Search
CPC ..... A24B 3/14; A24B 15/14
(Continued)

(56) References Cited

U.S. PATENT DOCUMENTS 2,592,554 A * 4/1952 Frankenburg ..... A24B 15/14 536/3
2,769,734 A * 11/1956 Bandel ..... A24B 15/12 131/355

(Continued)

FOREIGN PATENT DOCUMENTS

CN 103431514 A 12/2013
DE 1 546 296 B 4/1970

(Continued)

OTHER PUBLICATIONS https://www.netafimusa.com/wp-content/uploads/2016/10/Mesh-vs-Micron.pdf (Year: 2016).*

(Continued)

*Primary Examiner* — Kelly M Gambetta
*Assistant Examiner* — Russell E Sparks
(74) *Attorney, Agent, or Firm* — Oblon, McClelland, Maier & Neustadt, L.L.P.

(57) ABSTRACT

A method of forming homogenized tobacco material is provided, including forming a homogenized slurry including tobacco powder; casting the homogenized slurry onto a moving belt; incorporating a porous reinforcement sheet into the cast homogenized slurry; and drying the cast homogenized slurry with the incorporated porous reinforcement sheet to form the homogenized tobacco material, the porous reinforcement sheet having anisotropic properties such that the porous reinforcement sheet has a higher tensile strength (Continued)

Figure 1:
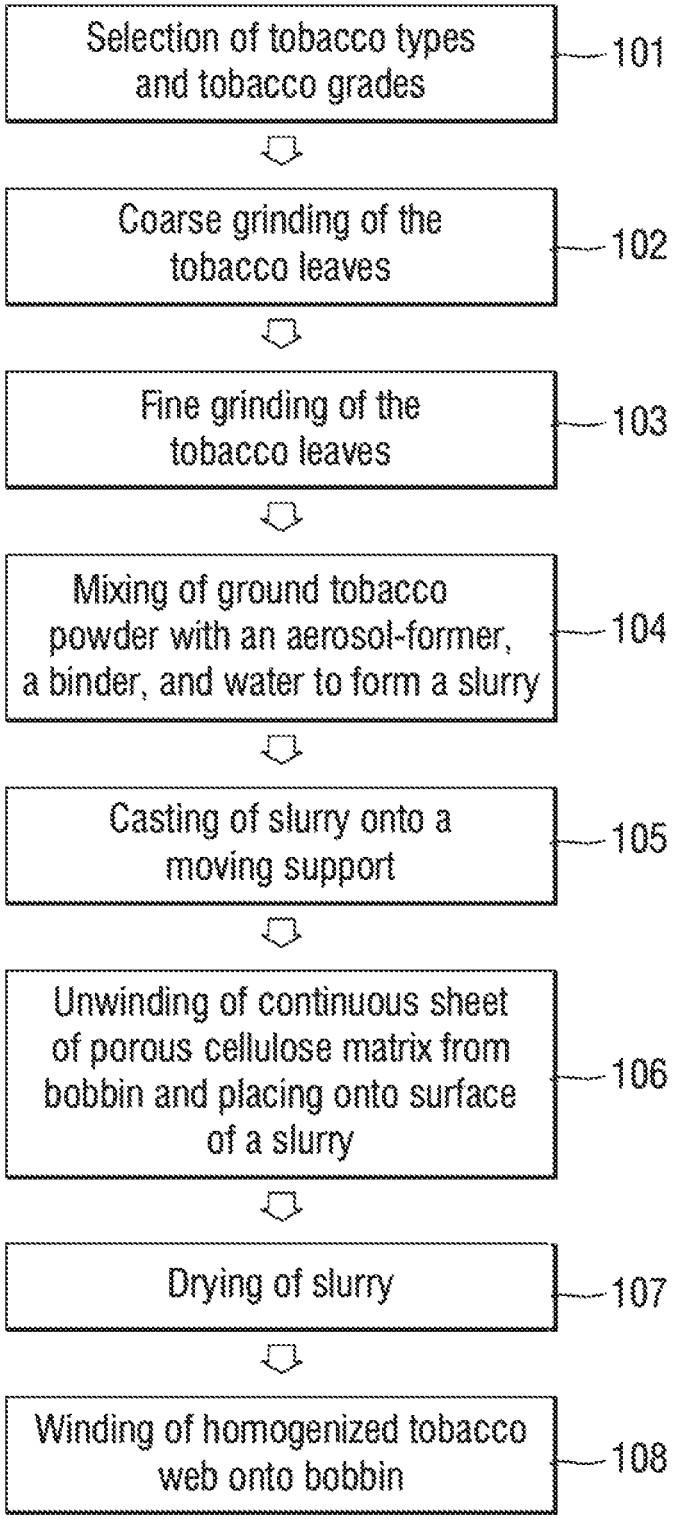

in a longitudinal direction thereof than in a transverse direction thereof.

14 Claims, 2 Drawing Sheets

(58) Field of Classification Search
USPC ..... 131/353
See application file for complete search history.

(56) References Cited

U.S. PATENT DOCUMENTS

| | | | | | |
|---|---|---|---|---|---|
| 3,003,895 | A * | 10/1961 | Grunwald | A24B 15/12 | 131/354 |
| 3,012,914 | A | 12/1961 | Battista et al. | | |
| 3,125,098 | A * | 3/1964 | Osborne | A24B 15/12 | 131/355 |
| 3,459,195 | A | 8/1969 | Silberman | | |
| 4,144,894 | A * | 3/1979 | Schmidt | A24B 15/14 | 131/355 |
| 4,306,578 | A | 12/1981 | Schmidt et al. | | |
| 4,509,537 | A * | 4/1985 | Houminer | A24B 15/301 | 131/274 |
| 4,821,749 | A * | 4/1989 | Toft | A24B 3/14 | 131/297 |
| 5,462,073 | A * | 10/1995 | Bowen | A24B 3/14 | 131/297 |
| 5,724,998 | A * | 3/1998 | Gellatly | A24B 15/14 | 131/372 |
| 8,136,533 | B2 * | 3/2012 | Mua | A24C 5/20 | 131/358 |
| 2008/0216854 | A1 * | 9/2008 | Nicholls | A24B 15/12 | 131/372 |
| 2013/0133675 | A1 * | 5/2013 | Shinozaki | A24F 47/006 | 131/329 |

FOREIGN PATENT DOCUMENTS

| | | | |
|---|---|---|---|
| EP | 0 565 360 | A2 | 10/1993 |
| EP | 3 154 379 | B1 | 7/2018 |
| GB | 961866 | | 6/1964 |
| JP | 54-41397 | | 4/1979 |
| JP | 06-46817 | A | 2/1994 |
| JP | 07-147965 | A | 6/1995 |
| JP | 2015-504118 | A | 2/2015 |
| JP | 2017-522003 | | 8/2017 |
| RU | 2 336 789 | C1 | 10/2008 |
| WO | WO 2015/193031 | A1 | 12/2015 |

OTHER PUBLICATIONS

Office Action dated Mar. 25, 2019 in European Patent Application No. 16734617.0, citing document AO therein, 4 pages.

International Search Report and Written Opinion dated Oct. 5, 2016 in PCT/EP2016/065223 filed Jun. 29, 2016.

Combine Russian Federation Office Action and Search Report dated Aug. 27, 2019 in Patent Application No. 2018112405/12(019401) (with English translation and English translation of categories of cited documents), citing documents AO and AP therein, 15 pages.

Japanese Office Action dated Jun. 22, 2020 in corresponding Japanese Patent Application No. 2018-512281 (with English translation), citing references AO-AR therein, 11 pages.

Chinese Office Action and Search Report dated Jun. 2, 2020 in corresponding Chinese Application No. 201680049545.9 (with English translation) citing reference AO therein, 20 pages.

Japanese Office Action dated Apr. 1, 2021 in corresponding Japanese Patent Application No. 2018-512281 (with English translation), citing document AO therein, 17 pages.

* cited by examiner

METHOD OF PRODUCING HIGH TENSILE STRENGTH HOMOGENIZED TOBACCO MATERIAL

This invention relates to a process for producing high tensile strength homogenized tobacco material. In particular, the invention relates to a process for producing homogenized tobacco material for use in an aerosol-generating article such as, for example, a cigarette or a "heat-not-burn" type tobacco containing product.

Homogenized tobacco material is frequently used in the production of tobacco products. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf. The process to form homogenized tobacco material sheets commonly comprises a step in which tobacco dust and a binder are mixed to form a slurry. The slurry is then used to create a tobacco web. For example, a tobacco web may be formed by casting a viscous slurry onto a moving metal belt to produce so called cast leaf. Alternatively, a slurry with low viscosity and high water content can be used to create reconstituted tobacco in a process that resembles papermaking. Once prepared, homogenized tobacco webs may be cut in a similar fashion as whole leaf tobacco to produce tobacco cut filler suitable for cigarettes and other smoking articles. The function of the homogenized tobacco for use in conventional cigarettes is substantially limited to physical properties of tobacco, such as filling power, resistance to draw, tobacco rod firmness and burn characteristics. This homogenized tobacco is typically not designed to have taste impact. An exemplary process for making such homogenized tobacco is disclosed in European Patent EP 0565360.

When handling a web of reconstituted tobacco, care must be taken to avoid exerting excess stress during conveying, pulling, winding and unwinding of the web. In order to improve the strength of the web sufficiently to handle the web at adequate processing speeds, it is common to include binders and fibres to increase the web strength of the reconstituted tobacco. Even so, the speed at which the web can be fed through processing apparatus without risk of tearing the web is relatively low. It would be desirable to be able to increase the speed at which webs of reconstituted tobacco may be processed and to reduce the incidence of breakage of such webs during processing.

Reconstituted tobacco material that is intended for use as an aerosol-forming substrate of a heated aerosol-generating article tends to have a different composition to reconstituted tobacco intended for use as filler in conventional cigarettes. In a heated aerosol-generating article, an aerosol-forming substrate is heated to a relatively low temperature, for example about 350° centigrade, in order to form an inhalable aerosol. In order that an aerosol may be formed, the reconstituted tobacco material preferably comprises high proportions of aerosol-formers and humectants such as glycerine or propylene glycol. The need for higher proportions of aerosol-formers and humectants results in a significant loss of mechanical strength in the homogenized tobacco. Thus, sheets or webs of homogenized tobacco intended for use as an aerosol-forming substrate of an aerosol-generating article have a far greater tendency to break or tear when subjected to pulling forces, such as experienced during winding and unwinding of reels the tobacco material. Thus, processing line speeds of such materials are extremely low, and there are regular stoppages during manufacturing due to breakages. This negatively impacts production and increases scrap rate. Thus, it may be particularly desirable to increase the pulling strength of a reconstituted tobacco web intended for use as an aerosol-forming substrate of an aerosol-generating article. The inclusion of higher percentages of reinforcement materials, such as cellulose fibres derived from wood pulp, can increase the strength of the homogenized tobacco material. However, the addition of high levels of extrinsic reinforcement alters the overall composition of the homogenized tobacco and may make it difficult to obtain the desired taste profiles in heated aerosol-generating articles by lowering the proportion of flavor generating components and aerosol-formers. Furthermore, aerosol-forming substrates for heated aerosol-generating articles may be conveniently formed by gathering sheets of homogenized tobacco material into rods. The addition of reinforcement fibres to improve the tensile strength of the sheet will affect the ability of the sheet to be gathered and may, therefore, affect properties of the aerosol-forming substrate such as its porosity and resistance to draw (RTD).

Therefore, there is a need for a new method of preparing a homogenized tobacco web having improved strength. Such a method may be particularly desired for preparing a homogenized tobacco web for the use in heated aerosol-generating articles of the "heat-not-burn" type that is adapted to the different heating characteristics and aerosol forming needs of such a heated aerosol-generating article. Such a homogenized tobacco web should further be adapted to withstand the required manufacturing processes such as gathering of the web into a rod. It is preferred that the composition of the homogenized tobacco material is not substantially altered. In other words, for a given homogenized tobacco material composition would be desirable if the tensile strength of the material could be improved without substantially changing the ratio of tobacco, aerosol-former, binder, and cellulose reinforcement.

According to a first aspect, the invention relates to a method for the production of a homogenized tobacco material. The method comprises the steps of forming a homogenized slurry comprising tobacco powder, casting the homogenized slurry onto a moving support or belt, incorporating a porous reinforcement sheet into the cast homogenized slurry, and drying the cast homogenized slurry with the incorporated porous reinforcement sheet to form the homogenized tobacco material. The porous reinforcement sheet has anisotropic properties such that it has a higher tensile strength in its longitudinal direction than in its transverse direction. The porous reinforcement sheet is incorporated in the homogenized tobacco material such that the tensile strength of the homogenised tobacco material is greater in its longitudinal direction than in its transverse direction.

The porous reinforcement sheet must be sufficiently porous for the homogenized slurry to permeate into the porous reinforcement sheet before the slurry dries, thereby incorporating the reinforcement sheet into the homogenized tobacco product. Preferably, the porous reinforcement sheet is encapsulated within dried homogenized slurry to form the homogenized tobacco material. The porous reinforcement sheet may alternatively be termed a porous reinforcement matrix. The porous reinforcement sheet may be a porous fibre sheet or a porous fibre matrix, such as a porous cellulose sheet or a paper sheet, or a porous woven fabric.

The porous reinforcement sheet may be applied to the surface of the cast homogenized slurry such that the porous reinforcement sheet becomes incorporated into the cast homogenized slurry. Alternatively, the porous reinforcement sheet may be applied to the moving support prior to the step of casting the slurry and the slurry may be cast onto the porous reinforcement sheet such that the porous reinforcement sheet becomes incorporated into the cast homogenized slurry. This may provide an additional advantage that adhesion between the cast homogenized slurry and the moving support may be reduced resulting in a lower mechanical force being required to remove the homogenised tobacco material from the support after drying. Homogenized slurry may be cast or spread onto both sides of the porous reinforcement sheet.

In a typical process for producing homogenized tobacco material, cellulose fibres are added to the slurry to act as a reinforcement. For example, it is typical for 2-3 weight percent of a homogenized tobacco material to be cellulose fibres that were added to the slurry. In the present method it is preferred that no extrinsic cellulose fibres, or other reinforcement fibres, are added to the slurry and that the reinforcement is provided by the porous reinforcement sheet incorporated into the slurry after casting the slurry. By incorporating the reinforcing material, which may be cellulose material, into the homogenized tobacco material as a pre-formed sheet or matrix, rather than as loose fibres, the longitudinal tensile strength of the homogenized tobacco sheet can be increased three or four times without substantially changing the overall composition of the homogenized tobacco material. This method provides a useful means to increase the strength, and strain to failure, of the tobacco material without using any additional additives, such as a higher proportion of binder or a higher proportion of reinforcing fibres, to the slurry mixture. The longitudinal strength of the homogenized tobacco material is thus increased without substantially changing the overall composition of the material. This can be particularly important where the homogenized tobacco material is used for heated aerosol-generating articles and the composition has been carefully formulated to provide a specific taste.

Furthermore, the use of a porous reinforcement sheet that has anisotropic properties provides a number of benefits. Homogenised tobacco material formed as described herein is formed as a continuous sheet having a longitudinal direction and a transverse direction. The porous reinforcement material incorporated within the homogenized tobacco material is also supplied as a continuous sheet having a longitudinal direction and a transverse direction. As the major strains applied to the homogenised tobacco material during formation and subsequent processing are in the longitudinal direction, it is desirable to increase the tensile strength of the homogenized tobacco material in its longitudinal direction. For example, if the porous reinforcement sheet is a porous fibre sheet then the fibres forming that sheet should be mainly unidirectional and mainly oriented along the longitudinal direction of the sheet. Fewer transverse fibres are required to bind the longitudinal structure and form the fibres into a sheet. A suitable material may be, for example, a bidirectional fabric such as a gauze formed from cotton fibres.

The use of an anisotropic reinforcement sheet allows the homogenized tobacco material to be strengthened to a sufficient degree in its longitudinal direction without using excessive reinforcement material strengthening the homogenized tobacco material in its transverse direction. This means that, for example, a reinforcement sheet that forms 3 wt % of the fully formed homogenized tobacco web may provide the same longitudinal strengthening as, say, 5 wt % of extrinsic reinforcement fibres added to the slurry.

Where the homogenized tobacco material is to be formed into a product by gathering into a rod it may be particularly advantageous to increase the longitudinal tensile strength and strain to failure in the longitudinal direction without excessively increasing the tensile strength in the transverse direction. This may enable the sheet or web to be handled efficiently and at speed while remaining compliant enough in the transverse direction to be gathered into a rod with desired porosity and RTD.

The porous reinforcement preferably extends across at least 75% of the width of the homogenized tobacco material formed by the method, preferably at least 90%, preferably 100% of the width of the homogenized tobacco material. It is preferred that the porous reinforcement sheet is of substantially the same width as the cast homogenized slurry. That is, it is preferred that the porous reinforcement sheet is at least 90% of the width of the cast homogenized slurry, preferably at least 95%. It is preferred that the porous reinforcement sheet is incorporated as a single sheet. As an alternative, however, multiple sheets or multiple webs may be incorporated into the homogenized tobacco material, as long as substantially all of the width of the cast homogenized slurry has porous reinforcement sheet incorporated in it. The porous reinforcement sheet may be wider than the cast homogenized slurry and edges of the reinforcement sheet may be trimmed after casting to coincide with the edge of the slurry. The homogenized tobacco material formed by the process retains the porous reinforcement sheet. That is, the porous reinforcement sheet is not removed from the homogenized tobacco material. An aerosol-forming substrate formed from the homogenized tobacco material will include the porous reinforcement sheet.

A porous reinforcement formed sheet from cellulose is a preferred reinforcement material. However, other materials may be used. For example, the porous reinforcement sheet may be a sheet that can be described as a porous fibre sheet or porous fibre matrix. The fibres of the sheet may be formed from other polymer materials such as polyethylene, polyester, polyphenylene sulphide, or a polyolefin. The fibres may be natural materials such as cotton.

The weight and porosity of the porous reinforcement sheet is preferably selected such that the sheet neither sits on top of the cast homogenized slurry, nor sinks to the bottom of the cast homogenized slurry. It has been determined that a grammage within the range 10 g to 20 g per square metre is particularly suitable. Preferably the grammage of the sheet is about 14 g per square metre. The porosity, or air permeability, of the porous reinforcement sheet is preferably within the range 30 to 30,000 Coresta Units of air permeability as measured according to ISO2965.

The porous reinforcement sheet may comprise an active component. For example, the porous reinforcement sheet may be a flavoured matrix or a tobacco matrix. The porous reinforcement sheet may comprise a volatile element such as nicotine that can contribute to an aerosol evolved from the homogenized tobacco material. The porous reinforcement sheet may comprise a flavouring selected from the list consisting of tobacco, menthol, lemon, vanilla, orange, wintergreen, cherry, and cinnamon.

The incorporation of a reinforcement sheet into the homogenized slurry may increase the tensile strength of the resulting homogenized tobacco material sufficiently that a binder is not required in the composition. The slurry may, however, additionally comprise a binder to further increase the strength of the homogenized tobacco sheet.

The slurry may further comprise an aerosol-former. For example, the slurry may comprise an aerosol-former selected from the list consisting of propylene glycol, triethylene glycol, 1,3-butanediol, glycerine, glycerol monoacetate, glycerol diacetate, glycerol triacetate, dimethyl dodecanedioate, and dimethyl tetradecanedioate. The slurry additionally comprises water.

The homogenized slurry is produced by mixing the various components of the slurry. It is preferred that mixing of the slurry is performed using a high energy mixer or a high shear mixer. Such mixing breaks down and distributes the various phases of the slurry evenly.

In some embodiments, a slurry may be formed by combining the tobacco blend powder of different tobacco types with a binder. Thus, the flavour of the homogenized tobacco material may be controlled by blending different tobaccos.

In some embodiments tobacco is ground to form the tobacco powder. For example, tobacco may be ground to form a powder having a specified particle size. Thus, a grinding step may produce a tobacco powder or tobacco powder blend having a mean powder particle size comprised between about 0.03 millimetres and about 0.12 millimetres.

If a binder is used, the binder is preferably added into the slurry in an amount between about 1 percent and about 5 percent in dry weight basis of the total weight of the slurry. The resultant homogenized tobacco material comprises an extrinsic binder in an amount between about 1 percent and about 5 percent in dry weight basis of the total weight of the homogenized tobacco material.

The term "homogenized tobacco material" is used throughout the specification to encompass any tobacco material formed by the agglomeration of particles of tobacco material. Sheets or webs of homogenized tobacco are formed by agglomerating particulate tobacco obtained by grinding or otherwise powdering of one or both of tobacco leaf lamina and tobacco leaf stems.

In addition, homogenized tobacco material may comprise a minor quantity of one or more of tobacco dust, tobacco fines, and other particulate tobacco by-products formed during the treating, handling and shipping of tobacco.

As the tobacco present in the homogenized tobacco material constitutes substantially the only—or the majority of—tobacco present in a heated aerosol-generating article, the impact on the characteristics of the aerosol, such as its flavour, derives predominantly from the homogenized tobacco material. It is preferred that the release of substances from the tobacco present in the homogenized tobacco material is simplified, in order to optimize use of tobacco. In preferred embodiments, the tobacco powder has an average particle size of the same size or below the size of the tobacco cell structure. It is believed that fine grinding to about 0.05 millimetres can advantageously open the tobacco cell structure and in this way the aerosolization of tobacco substances from the tobacco itself is improved. Examples of substances for which the aerosolization may be improved by providing tobacco powder with a mean powder size between about 0.03 millimetres and about 0.12 millimetres are pectin, nicotine, essential oils and other flavours.

The binder used in the slurry can be any of the gums or pectins described herein. The binder may ensure that the tobacco powder remains substantially dispersed throughout the homogenized tobacco web. For a descriptive review of gums, see Gums And Stabilizers For The Food Industry, IRL Press (G. O. Phillip et al. eds. 1988); Whistler, Industrial Gums: Polysaccharides And Their Derivatives, Academic Press (2d ed. 1973); and Lawrence, Natural Gums For Edible Purposes, Noyes Data Corp. (1976).

Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

The method may comprise the step of vibrating the slurry. Vibrating the slurry, that is for example vibrating a tank or silo where the slurry is present, may help the homogenization of the slurry. Less mixing time may be required to homogenize the slurry to the target value optimal for casting is together with mixing also vibrating is performed.

Advantageously, the method may comprise the step of further adding an aerosol-former to the slurry. Aerosol formers included in the slurry that forms cast leaf may be chosen based on one or more characteristics. Functionally, the aerosol former provides a mechanism that allows it to be volatilized and convey nicotine and/or flavouring in an aerosol when heated above the specific volatilization temperature of the aerosol former. An aerosol-former may be any suitable compound or mixture of compounds that, in use, facilitates formation of a dense and stable aerosol and is substantially resistant to thermal degradation at the operating temperature of the heated aerosol-generating article. Different aerosol formers vaporize at different temperatures so an aerosol former may be chosen based on its ability, e.g., to remain stable at or around room temperature but able to volatize at a higher temperature, e.g., between 40-450° C.

The aerosol former may also have humectant type properties that help maintain a desirable level of moisture in an aerosol forming substrate when the substrate is composed of a tobacco-based product including tobacco particle. In particular, some aerosol formers are hygroscopic material that function as a humectant, i.e., a material that helps keep a substrate containing the humectant moist.

Suitable aerosol-formers for inclusion in slurry for webs of homogenized tobacco material are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate, dimethyl tetradecanedioate, erythritol, 1,3-butylene glycol, tetraethylene glycol, triethyl citrate, propylene carbonate, ethyl laurate, triactin, meso-erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

For example, where the homogenized tobacco material according to the specification is intended for use as aerosol-forming substrates in heated aerosol-generating articles, webs of homogenized tobacco material may have an aerosol-former content of between about 5 percent and about 30 percent by weight on a dry weight basis. Homogenized tobacco webs intended for use in electrically-operated aerosol-generating system having a heating element may preferably include an aerosol former of between about 5 percent to about 30 percent of dry weight of the homogenized tobacco material, preferably between about 10 percent to about 25 percent of dry weight of the homogenized tobacco material. For homogenized tobacco webs intended for use in electrically-operated aerosol-generating system having a heating element, the aerosol former may preferably be glycerol (also known as glycerin or glycerine) or propylene glycol.

One or more aerosol former may be combined to take advantage of one or more properties of the combined aerosol formers. For example, triactin may be combined with glycerin and water to take advantage of the triactin's ability to convey active components and the humectant properties of the glycerin.

A web of homogenized tobacco material is preferably formed by a casting process of the type generally comprising casting a slurry prepared including the blend of tobacco powder above described on a moving support surface such as a moving belt. The porous reinforcement sheet may be applied to the surface of the cast homogenized slurry to become incorporated into the slurry. Alternatively, the porous reinforcement sheet may be applied to the surface of the moving belt and the homogenized slurry cast onto the porous reinforcement sheet. In either case, the cast web with incorporated reinforcement sheet is then dried to form a web of homogenized tobacco material and it is then removed from the support surface.

Preferably, the moisture of said cast tobacco material web at casting is between about 60 percent and about 80 percent of the total weight of the tobacco material at casting. Preferably, the method for production of a homogenized tobacco material comprises the step of drying said cast web, winding said cast web, wherein the moisture of said cast web at winding is between about 7 percent and about 15 percent of dry weight of the tobacco material web. Preferably, the moisture of said homogenized tobacco web at winding is between about 8 percent and about 12 percent of dry weight of the homogenized tobacco web.

In some embodiments two or more different tobaccos are blended. Preferably, said step of blending tobacco comprises blending one or more of the following tobaccos, bright tobacco, dark tobacco; aromatic tobacco; filler tobacco. The homogenized tobacco material may be formed by tobacco lamina and stem of different tobacco types, which are properly blended. With the term "tobacco type" one of the different varieties of tobacco is meant. These different tobacco types are distinguished in three main groups of bright tobacco, dark tobacco and aromatic tobacco. The distinction between these three groups is based on the curing process the tobacco undergoes before it is further processed in a tobacco product.

Bright tobaccos are tobaccos with a generally large, light coloured leaves. Throughout the specification, the term "bright tobacco" is used for tobaccos that have been flue cured. Examples for bright tobaccos are Chinese Flue-Cured, Flue-Cured Brazil, US Flue-Cured such as Virginia tobacco, Indian Flue-Cured, Flue-Cured from Tanzania or other African Flue Cured. Bright tobacco is characterized by a high sugar to nitrogen ratio. From a sensorial perspective, bright tobacco is a tobacco type which, after curing, is associated with a spicy and lively sensation. According to the invention, bright tobaccos are tobaccos with a content of reducing sugars of between about 2.5 percent and about 20 percent of dry weight base of the leaf and a total ammonia content of less than about 0.12 percent of dry weight base of the leaf. Reducing sugars comprise for example glucose or fructose. Total ammonia comprises for example ammonia and ammonia salts.

Dark tobaccos are tobaccos with a generally large, dark coloured leaves. Throughout the specification, the term "dark tobacco" is used for tobaccos that have been air cured. Additionally, dark tobaccos may be fermented. Tobaccos that are used mainly for chewing, snuff, cigar, and pipe blends are also included in this category. From a sensorial perspective, dark tobacco is a tobacco type which, after curing, is associated with a smoky, dark cigar type sensation. Dark tobacco is characterized by a low sugar to nitrogen ratio. Examples for dark tobacco are Burley Malawi or other African Burley, Dark Cured Brazil Galpao, Sun Cured or Air Cured Indonesian Kasturi. Dark tobaccos tend to be tobaccos with a content of reducing sugars of less than about 5 percent of dry weight base of the leaf and a total ammonia content of up to about 0.5 percent of dry weight base of the leaf.

Aromatic tobaccos are tobaccos that often have small, light coloured leaves. Throughout the specification, the term "aromatic tobacco" is used for other tobaccos that have a high aromatic content, for example a high content of essential oils. From a sensorial perspective, aromatic tobacco is a tobacco type which, after curing, is associated with spicy and aromatic sensation. Examples for aromatic tobaccos are Greek Oriental, Oriental Turkey, semi-oriental tobacco but also Fire Cured, and US Burley, such as Perique, Rustica, US Burley or Maryland.

Additionally, a blend may comprise so called filler tobaccos. Filler tobacco is not a specific tobacco type, but it includes tobacco types which are mostly used to complement the other tobacco types used in the blend and do not bring a specific characteristic aroma direction to the final product. Examples for filler tobaccos are stems, midrib or stalks of other tobacco types. A specific example may be flue cured stems of Flue Cured Brazil lower stalk.

Within each type of tobaccos, the tobacco leaves are further graded for example with respect to origin, position in the plant, colour, surface texture, size and shape. These and other characteristics of the tobacco leaves are used to form a tobacco blend. A blend of tobacco is a mixture of tobaccos belonging to the same or different types such that the tobacco blend has an agglomerated specific characteristic. This characteristic can be for example a unique taste or a specific aerosol composition when heated or burned. A blend comprises specific tobacco types and grades in a given proportion one with respect to the other.

Different grades within the same tobacco type may be cross-blended to reduce the variability of each blend component. According to the invention, the different tobacco grades are selected in order to realize a desired blend having specific predetermined characteristics. For example, the blend may have a target value of the reducing sugars, total ammonia and total alkaloids per dry weight base of the homogenized tobacco material. Total alkaloids are for example nicotine and the minor alkaloids including nornicotine, anatabine, anabasine and myosmine.

For example, bright tobacco may comprise tobacco of grade A, tobacco of grade B and tobacco of grade C. Bright tobacco of grade A has slightly different chemical characteristics to bright tobacco of grade B and grade C. Aromatic tobacco may include tobacco of grade D and tobacco of grade E, where aromatic tobacco of grade D has slightly different chemical characteristics to aromatic tobacco of grade E. A possible target value for the tobacco blend, for the sake of exemplification, can be for example a content of reducing sugars of about 10 percent in dry weight basis of the total tobacco blend. In order to achieve the selected target value, a 70 percent bright tobacco and a 30 percent aromatic tobacco may be selected in order to form the tobacco blend. The 70 percent of the bright tobacco is selected among tobacco of grade A, tobacco of grade B and tobacco of grade C, while the 30 percent of aromatic tobacco is selected among tobacco of grade D and tobacco of grade E. The amounts of tobaccos of grade A, B, C, D, E which are included in the blend depend on the chemical composition of each of the tobaccos of grades A, B, C, D, E so as to meet the target value for the tobacco blend.

According to an aspect of the invention, a web of homogenized tobacco material may be provided comprising a porous reinforcement sheet incorporated within a dried tobacco slurry. The web of homogenised tobacco material has a tensile strength that is greater in its longitudinal direction than in its transverse direction. Preferably the web of homogenised tobacco material has a tensile strength that is more than 1.5 times greater in its longitudinal direction than in its transverse direction, preferably more than 2 times greater in its longitudinal direction than in its transverse direction, for example more than 2.5 times greater in its longitudinal direction than in its transverse direction.

The porous reinforcement sheet incorporated within the web of homogenized tobacco material has anisotropic properties such that it has a higher tensile strength in its longitudinal direction than in its transverse direction. The porous reinforcement sheet is incorporated in the homogenized tobacco material such that the tensile strength of the homogenised tobacco material is greater in its longitudinal direction than in its transverse direction.

Preferably, the porous reinforcement sheet makes up between 2 weight percent and 10 weight percent of the homogenized tobacco material. Preferably, the porous reinforcement sheet makes up the total amount of extrinsic reinforcement in the homogenized tobacco material. In other words, it is preferred that the homogenized tobacco material does not contain reinforcement fibres such as cellulose fibres that have been added to the slurry as loose fibres during production of the homogenized tobacco material.

The homogenized tobacco material may comprise a porous fibre sheet incorporated within a dried tobacco slurry. The fibres of the porous fibre sheet may be cellulose. The fibres of the porous fibre sheet may be a polymer material, such as polyethylene, polyester, polyphenylene sulphide, or a polyolefin. The fibres of the porous fibre sheet may be a natural fibre such as cotton.

The homogenized tobacco material is preferably formed using a method as disclosed above.

According to an aspect of the invention, an aerosol-generating article may be provided, the aerosol-generating article comprising a portion of the homogenized tobacco material as described above or produced using the method described above.

An aerosol-generating device is an article comprising an aerosol-forming substrate that is capable of releasing volatile compounds that can form an aerosol. An aerosol-generating article may be a non-combustible aerosol-generating article or may be a combustible aerosol-generating article. Non-combustible aerosol-generating article releases volatile compounds without the combustion of the aerosol-forming substrate, for example by heating the aerosol-forming substrate, or by a chemical reaction, or by mechanical stimulus of an aerosol-forming substrate. Combustible aerosol-generating article releases an aerosol by direct combustion of an aerosol-forming substrate, for example as in a conventional cigarette.

The aerosol-forming substrate is capable of releasing volatile compounds that can form an aerosol volatile compound and may be released by heating or combusting the aerosol-forming substrate. In order for the homogenized tobacco material to be used in an aerosol-forming generating article, aerosol formers are preferably included in the slurry that forms the cast leaf. The aerosol formers may be chosen based on one or more of predetermined characteristics. Functionally, the aerosol former provides a mechanism that allows the aerosol former to be volatilize and convey nicotine and/or flavouring in an aerosol when heated above the specific volatilization temperature of the aerosol former.

Figure 2:
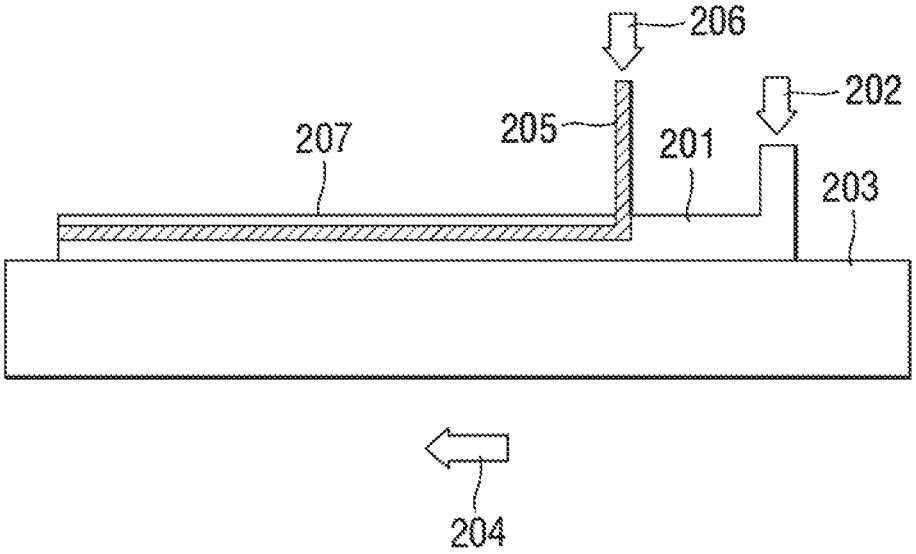

The invention will be further described, by way of example only, with reference to the accompanying drawings in which:

FIG. 1 shows a flow diagram of a method to produce an homogenized tobacco material according to the invention; and FIG. 2 is a schematic illustration showing a porous reinforcement sheet being applied to the surface of a cast tobacco slurry.

In a typical prior art process for manufacturing a web of reconstituted tobacco material, tobacco powder or dust is combined with cellulose fibres, a binder, and water to form a slurry. The slurry is then cast onto a moving belt and the slurry is dried to form the web of material. Such methods are well known to the skilled person. The slurry may further include other components, for example aerosol-formers such as glycerin. The cellulose fibres and the binder impart strength to the resulting homogenized tobacco material. A web intended for use as an aerosol-forming substrate in a heated aerosol-generating article may have a specific blend of tobacco and may have a high proportion of aerosol-former. As such, the web may have a low intrinsic strength. The strength of such a web may be increased by increasing the amount of cellulose fibre and binder, but this extra strength comes at the expense of the composition.

FIG. 1 is a flow diagram illustrating a method for the production of homogenized tobacco material according to a specific embodiment of the present invention. The first step of the method is the selection 101 of the tobacco types and tobacco grades to be used in the tobacco blend for producing the homogenized tobacco material. Tobacco types and tobacco grades used in the present method are for example bright tobacco, dark tobacco, aromatic tobacco and filler tobacco.

Further, the method includes a step 102 of coarse grinding of the tobacco leaves.

After the coarse grinding step 102, a fine grinding step 103 is performed. The fine grinding step reduces the tobacco powder mean size to between about 0.03 millimetres and about 0.12. This fine grinding step 103 reduces the size of the tobacco down to a powder size suitable for the slurry preparation. After this fine grinding step 103, the cells of the tobacco are at least partially destroyed and the tobacco powder may become sticky.

The so obtained tobacco powder can be immediately used to form the tobacco slurry. Alternatively, a further step of storage of the tobacco powder, for example in suitable containers, may be performed (not shown).

The ground tobacco powder is mixed with an aerosol-former, a binder, and water to form a slurry 104. Preferably, the aerosol-former comprises glycerol and the binder comprises guar.

Preferably, the step of slurry formation 104 also comprises a mixing step, where all the slurry ingredients are mixed together for a fixed amount of time. The mixing step uses a high shear mixer.

The slurry is then cast 105 onto a moving support, such as a steel conveyor belt. The slurry is preferably cast by means of a casting blade, A continuous sheet or web of porous reinforcement material is held on a bobbin. The sheet of porous reinforcement is a continuous porous cellulose sheet or matrix having a tensile strength that is greater in its longitudinal direction than in its transverse direction. In a specific example, this is achieved by the porous cellulose matrix comprising a greater number of longitudinally extending fibres than transversely extending fibres. Immediately after casting of the slurry 105, the continuous sheet of porous cellulose matrix is unwound from the bobbin and placed onto the surface of the slurry 106. As the slurry is wet and the cellulose matrix is porous the cellulose matrix absorbs a portion of the slurry and becomes incorporated into the slurry.

FIG. 2 is a schematic diagram showing this step in further detail. The unreinforced slurry 201 is cast 202 onto a surface of a moving support 203. The support 203 is moving in the direction indicated by arrow 204. A short distance downline of the point of casting the slurry, the sheet of porous cellulose matrix 205 is placed 206 onto the cast slurry 201. The cellulose matrix 205 becomes incorporated in the cast slurry, thereby forming a cellulose reinforced slurry 207.

As an alternative (not illustrated), the sheet of porous cellulose matrix may be unwound and applied to the moving support before the homogenized slurry is cast. The homogenized slurry may then be cast onto the sheet of porous cellulose on the moving support. As described before, as the slurry is wet and the cellulose matrix is porous the cellulose matrix absorbs a portion of the slurry and becomes incorporated into the slurry.

The cast slurry, now incorporating a sheet of porous cellulose 207, is then dried to form the homogenized tobacco web. The drying step 107 includes drying the cast web by means of steam and heated air. Preferably the drying with steam is performed on the side of the cast web in contact with the support, while the drying with heated air is performed on the free side of the cast web.

Preferably, at the end of the drying step 107, the homogenized tobacco web is removed from the support. The homogenized tobacco web is preferably wound in one or more bobbins in a winding step 108, for example to form a single master bobbin. This master bobbin may be then used to perform the production of smaller bobbins by slitting and small bobbin forming process. The smaller bobbin may then be used for the production of an aerosol-generating article (not shown).

The web of homogenized tobacco material may be used to form aerosol-forming substrates for use in aerosol-generating articles. For example, a sheet of the homogenized tobacco material may be gathered to form a rod of aerosol-forming substrate for a heated aerosol-generating article.

The fracture force and strain of a sheet of homogenized tobacco, produced as described above, was tested. It was found that both strength and strain increased significantly when compared with a homogenized tobacco sheet containing approximately the same amount of cellulose fibre in the form of loose fibres added to a slurry (a control or reference homogenized tobacco web). Furthermore, the tensile strength in the longitudinal direction of the sheet was found to be about double the tensile strength in the transverse direction of the sheet.

Furthermore, aerosol-generating articles were formed from both the strengthened homogenized tobacco web formed as disclosed above and the reference homogenized tobacco web. The articles were smoked under Health Canada conditions and the transfer rates of nicotine and glycerine were measured. It was found that the transfer rates in both articles was very similar, showing that the strength of the tobacco material can be improved without substantially altering the delivery of aerosol.

The invention claimed is:

1. A method of forming homogenized tobacco material for an aerosol-generating article for generating an aerosol upon heating, comprising:

forming a homogenized slurry comprising tobacco powder;

applying a porous reinforcement sheet to a moving belt;

casting the homogenized slurry onto the porous reinforcement sheet, the porous reinforcement sheet thereby becoming incorporated in the cast homogenized slurry;

drying the cast homogenized slurry with the incorporated porous reinforcement sheet to form the homogenized tobacco material, wherein the homogenized slurry comprising tobacco powder comprises an aerosol former in an amount such that a content of aerosol former in the formed homogenized tobacco material is between 10 percent and 25 percent, the aerosol former being glycerol or propylene glycol or a mixture thereof, wherein the porous reinforcement sheet extends across at least 75% of a width of the formed homogenized tobacco material, wherein the porous reinforcement sheet is a porous fiber sheet, the fibers of the porous reinforcement sheet being formed of a natural material, wherein the porous reinforcement sheet makes up between 2 weight percent and 10 weight percent of the homogenized tobacco material, wherein the porous reinforcement sheet has anisotropic properties such that the porous reinforcement sheet has a higher tensile strength in a longitudinal direction thereof than in a transverse direction thereof, wherein the porous reinforcement sheet has a porosity of between 30 Coresta units of air permeability and 30,000 Coresta units of air permeability, and wherein the porous reinforcement sheet makes up the total amount of extrinsic reinforcement in the homogenized tobacco material.

2. The method according to claim 1, wherein the homogenized slurry is cast or spread onto both sides of the porous reinforcement sheet, the porous reinforcement sheet thereby becoming incorporated in the cast homogenized slurry.

3. A method of forming homogenized tobacco material for an aerosol-generating article for generating an aerosol upon heating, comprising:

forming a homogenized slurry comprising tobacco powder;

casting the homogenized slurry onto a moving belt;

incorporating a porous reinforcement sheet into the cast homogenized slurry; and drying the cast homogenized slurry with the incorporated porous reinforcement sheet to form the homogenized tobacco material, wherein the homogenized slurry comprising tobacco powder comprises an aerosol former in an amount such that a content of aerosol former in the formed homogenized tobacco material is between 10 percent and 25 percent, the aerosol former being glycerol or propylene glycol or a mixture thereof, wherein the porous reinforcement sheet extends across at least 75% of a width of the formed homogenized tobacco material, wherein the porous reinforcement sheet is a porous fiber sheet, the fibers of the porous reinforcement sheet being formed of a natural material, wherein the porous reinforcement sheet makes up between 2 weight percent and 10 weight percent of the homogenized tobacco material, wherein the porous reinforcement sheet has anisotropic properties such that the porous reinforcement sheet has a higher tensile strength in a longitudinal direction thereof than in a transverse direction thereof, wherein the porous reinforcement sheet has a porosity of between 30 Coresta units of air permeability and 30,000 Coresta units of air permeability, and wherein the porous reinforcement sheet makes up the total amount of extrinsic reinforcement in the homogenized tobacco material.

4. The method according to claim 3, wherein the porous reinforcement sheet is applied to an upper surface of the cast homogenized slurry thereby becoming incorporated in the cast homogenized slurry.

5. The method according to claim 3, wherein the homogenized slurry further comprises a binder.

6. The method according to claim 3, wherein the porous reinforcement sheet is of substantially a same width as that of the cast homogenized slurry.

7. The method according to claim 3, wherein the porous reinforcement sheet has a grammage of between 10 g per square meter and 20 g per square meter.

8. The method according to claim 3, wherein the porous reinforcement sheet has a grammage of about 14 g per square meter.

9. The method according to claim 3, wherein the tobacco powder has a mean particle size of between 0.03 millimeters and 0.12 millimeters.

10. The method according to claim 5, wherein a total amount of the binder forms between 1 weight percent and 5 weight percent of a total weight of the homogenized tobacco material on a dry weight basis.

11. The method according to claim 3, wherein the homogenized slurry does not comprise any extrinsic reinforcement prior to being cast.

12. The method according to claim 3, wherein the porous reinforcement sheet comprises nicotine.

13. The method according to claim 3, wherein the porous reinforcement sheet comprises a flavoring selected from the group consisting of tobacco, menthol, lemon, vanilla, orange, wintergreen, cherry, and cinnamon.

14. The method according to claim 3, wherein the porous reinforcement sheet is a porous fiber sheet or a porous fiber matrix formed of natural fibers.

* * * * *